US009963869B1

(12) United States Patent
Mironchuk et al.

(10) Patent No.: US 9,963,869 B1
(45) Date of Patent: May 8, 2018

(54) REVERSIBLE ADJUSTABLE BRACKET ASSEMBLY FOR GLASS PANEL

(71) Applicant: Bath Authority LLC, Warminster, PA (US)

(72) Inventors: Vadym Mironchuk, Philadelphia, PA (US); Michael Minkovich, Richboro, PA (US); Brian Lieb, Philadelphia, PA (US); Patrick Van Kirk, Philadelphia, PA (US); Leo Volkov, Wynnewood, PA (US)

(73) Assignee: BATH AUTHORITY LLC, Warminster, PA (US)

( * ) Notice: Subject to any disclaimer, the term of this patent is extended or adjusted under 35 U.S.C. 154(b) by 0 days. days.

(21) Appl. No.: 15/824,142

(22) Filed: Nov. 28, 2017

(51) Int. Cl.

| | |
|---|---|
| ***E04B 1/41*** | (2006.01) |
| ***A47K 3/36*** | (2006.01) |
| ***E04B 2/72*** | (2006.01) |
| *E04B 1/38* | (2006.01) |

(52) U.S. Cl.
CPC ..... *E04B 1/40* (2013.01); *A47K 3/36* (2013.01); *E04B 2/721* (2013.01); *E04B 2001/405* (2013.01)

(58) Field of Classification Search
CPC ..... E04B 1/40; E04B 2/721; E04B 2001/405; A47K 3/36
See application file for complete search history.

(56) References Cited

U.S. PATENT DOCUMENTS 4,145,849 A * 3/1979 Shindoll ..... A47B 96/00 108/187
D409,858 S * 5/1999 Reed ..... D6/682.2
(Continued)

*Primary Examiner* — Paola Agudelo
(74) *Attorney, Agent, or Firm* — Fox Rothschild LLP

(57) ABSTRACT

A reversible adjustable bracket assembly for supporting an edge of a panel relative to a surface is disclosed. The assembly includes a mounting bracket, a reversible bracket member, an interior mounting bracket, and a panel bracket. The mounting bracket is configured for mounting on the surface and includes at least two fastening screw receiving holes. The bracket member has an extension arm extending perpendicularly from an elongated, narrowed proximal end to a mounting arm at a distal end thereof. The mounting arm defines at least two fastening screw receiving holes on a first surface and an oppositely disposed second surface thereof such that the bracket member body is configured to be reversible for mounting to the mounting bracket in at least one of a left-hand and right-hand installation thereof. The interior mounting bracket is configured for mounting to an inner side of the mounting bracket body and the first surface or the oppositely disposed second surface of the mounting arm and defines at least two fastening screw holes and at least two adjustment screw holes therethrough. Fastening screws extend through each fastening screw hole and are received in a respective fastening screw hole. An adjustment screw is positioned in each adjustment screw hole and is threadably adjustable to contact the mounting bracket body and adjust the angular relationship between the bracket member and the mounting bracket. A panel bracket is configured to support the edge of the panel at a proximate end of the extension arm.

16 Claims, 6 Drawing Sheets

(56) References Cited

U.S. PATENT DOCUMENTS

| | | | | |
|---|---|---|---|---|
| 8,707,475 | B2 * | 4/2014 | Johnson | A47K 3/30 4/557 |
| 2002/0062617 | A1 * | 5/2002 | diGirolamo | E04B 2/767 52/688 |
| 2008/0277363 | A1 * | 11/2008 | McDonough | A47B 63/00 211/189 |
| 2010/0307094 | A1 * | 12/2010 | Spyrou | E04B 1/003 52/489.1 |
| 2012/0096799 | A1 * | 4/2012 | Wright | E04F 13/0816 52/578 |
| 2014/0331564 | A1 * | 11/2014 | Wei | A47K 3/30 49/505 |
| 2016/0069072 | A1 * | 3/2016 | Rice | E04B 2/62 52/696 |
| 2016/0168869 | A1 * | 6/2016 | Curtis | E06B 1/34 52/716.2 |
| 2016/0206157 | A1 * | 7/2016 | Ball | A47K 3/34 |
| 2016/0265218 | A1 * | 9/2016 | Gosling | E04B 2/721 |
| 2017/0175380 | A1 * | 6/2017 | Nehls | E04B 1/40 |
| 2017/0204600 | A1 * | 7/2017 | Daudet | E04B 1/2403 |
| 2017/0362816 | A1 * | 12/2017 | Carbary | E04B 1/40 |

* cited by examiner

REVERSIBLE ADJUSTABLE BRACKET ASSEMBLY FOR GLASS PANEL

TECHNICAL FIELD

The present invention relates to the field of bathroom hardware, and more particularly, to a reversible adjustable bracket assembly for supporting a glass panel, for example, a glass panel of a shower enclosure.

BACKGROUND

For many years, the most commonly used enclosure for a tub/shower bathing facility has included a pair of sliding glass doors framed in metal. In a typical installation, an outer metal frame circumscribes the entry to the bath and is attached at the sides to the walls of the facility. The installation also includes a header spanning the entrance and a guide rail attached to the tub or shower base. The shower doors are hung at the top from the header and guided at the bottom by the rail so that they can slide back and forth in the entryway to allow entry and egress and to create a splash barrier.

There are several disadvantages with the described installation, both functional and aesthetic. First, the support structure is always present in the entryway to the bathing area, thus always at least partially blocking the entrance and restricting free access to the bathing area, a special problem when bathing a small child or when cleaning the facility. The header also adds an undesired obstruction in the entryway that must be avoided when entering or leaving the area. Moreover, the metal of the frame and all the glass-to-metal interfaces require special cleaning and maintenance. Apart from these functional constraints, the metal required for the framing, header and rail detracts from a clean and open appearance of the facility.

Various systems eliminating the shower door header have been utilized, including enclosure systems with the shower door hingedly or slidably connected to a glass panel, which is in turn mounted to an adjacent wall. A problem commonly arises in that the surrounding walls to which the glass panel is to be secured are out-of-square with respect to the shower enclosure. There has previously been a support arm, attached at one end to the stationary glass panel and at the other end to the wall, which provides stability to the stationary glass panel. This support arm forms the hypotenuse of a triangle described by the support arm, the wall, and the stationary glass panel. This arm is attached to the top edge of the stationary glass panel and at an equal height to the wall. In the case of the support arm, there is a restriction of free motion within the shower or bath as the arm is an obstruction at or below head-height for many people. These previous systems, including the support arm, allow an undesirable amount of deflection of the stationary glass panel.

It would thus be desirable to have an improved bracket assembly that can be utilized in various configurations to support a glass panel and facilitate adjustment to accommodate an out-of-square configuration, among other desirable features, as described herein, while avoiding the disadvantages of the known conventional enclosure systems.

SUMMARY

In a first aspect, there is provided herein a reversible adjustable bracket assembly for supporting an edge of a panel relative to a surface. The assembly includes a mounting bracket, a bracket member, an interior mounting bracket, and a panel bracket. The mounting bracket has a body configured for mounting on the surface and defining at least two fastening screw receiving holes. The bracket member has a body with an extension arm extending perpendicularly from an elongated, narrowed proximal end to a mounting arm at a distal end thereof. The mounting arm defines at least two fastening screw receiving holes on a first surface and an oppositely disposed second surface thereof such that the bracket member body is configured to be reversible for mounting to the mounting bracket in at least one of a left-hand and right-hand installation thereof. The interior mounting bracket has a body configured for mounting to an inner side of the mounting bracket body and the first surface or the oppositely disposed second surface of the mounting arm and defines at least two fastening screw holes and at least two adjustment screw holes therethrough. Each fastening screw hole aligns with a respective fastening screw receiving hole of the mounting bracket body and each adjustment screw hole aligns with a surface of the mounting bracket body. A first fastening screw extends through each fastening screw hole of the mounting arm and is received in a respective fastening screw hole on a top surface of the interior mounting bracket to secure the bracket member to the mounting bracket via the interior mounting bracket. A second fastening screw extends through each fastening screw of the interior mounting bracket body and is received in a respective fastening screw receiving hole of the mounting bracket body. An adjustment screw is positioned in each adjustment screw hole of the interior mounting bracket body such that each adjustment screw is threadably adjustable to contact the mounting bracket body and adjust the angular relationship between the bracket member and the mounting bracket. A panel bracket defines an enclosed longitudinal channel at a first end and is configured to receive the elongated, narrowed proximal end of the extension arm of the bracket member body therethrough. The panel bracket further defines an open longitudinal channel at a second end and is configured to support the edge of the panel.

In certain embodiments, the mounting bracket body includes at least two mounting through bores therethrough such that at least two mounting screws are secured through the mounting through bores for mounting of the mounting bracket on the surface.

In certain embodiments, each mounting through bore has an elongated configuration.

In certain embodiments, the interior mounting bracket body has a height and length substantially equal to a height and length of the mounting bracket body.

In certain embodiments, the interior mounting bracket body has a width greater than a width of the mounting bracket body.

In certain embodiments, the bracket member body is configured to be low-profile such that a height of the mounting and extension arms is less than a width thereof.

In certain embodiments, the elongated, narrowed proximal end of the extension arm has a height and width less than a height and width of the extension arm.

In certain embodiments, each adjustment screw is a set screw.

In certain embodiments, a plurality of set screws are secured through an outer surface of the panel bracket.

In certain embodiments, the panel bracket includes at least one friction pad disposed in the open longitudinal channel at the second end with the at least one friction pad disposed adjacent to an outer side wall of the panel bracket.

In certain embodiments, at least one set screw is secured through the outer side wall of the panel bracket at the first end and at least two set screws are secured through the outer side wall of the panel bracket at the second end such that the at least one friction pad contacts the edge of the panel in the open longitudinal channel at the second end when the at least two set screws are adjusted through the outer side wall of the panel bracket at the second end.

In certain embodiments, the panel bracket is configured to be detachable from the bracket member body.

In certain embodiments, the assembly further includes a longitudinal cover member configured to be positioned over and conceal the interior mounting bracket body and the mounting bracket body.

In certain embodiments, the longitudinal cover member includes a back surface and a bottom surface, both of which extend between opposed end surfaces.

In certain embodiments, each end surface defines an inward projection configured to be received and retained in a respective end surface extending along the mounting bracket body.

In a second aspect, there is provided herein a shower enclosure. The shower enclosure includes at least one reversible adjustable bracket assembly as disclosed herein with the mounting bracket secured to a wall that defines the surface. A glass panel is positioned along the surface with a top edge of the glass panel positioned in and supported by the panel bracket.

Various advantages of this disclosure will become apparent to those skilled in the art from the following detailed description, when read in light of the accompanying drawings.

DETAILED DESCRIPTION

This disclosure is not limited to the particular apparatus, systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All sizes recited in this document are by way of example only, and the present disclosure is not limited to the reversible adjustable bracket assembly having the specific sizes or dimensions recited herein. As used herein, the term "comprising" means "including, but not limited to."

In consideration of the figures, it is to be understood for purposes of clarity certain details of construction and/or operation are not provided in view of such details being conventional and well within the skill of the art upon disclosure of the document described herein. In the figures, like numerals indicate like elements throughout.

The present disclosure pertains to a reversible adjustable bracket assembly for supporting an edge of a panel of a shower enclosure relative to a surface, such as a wall. The adjustable bracket assembly is configured to be reversible so that a single bracket can be conveniently used for left-hand and right-hand installations in a shower enclosure. The reversible adjustable bracket assembly provides support for glass panels of different thicknesses. In addition, the reversible adjustable bracket assembly can be adjusted to compensate for uneven walls. The modular design of the reversible adjustable bracket assembly enables the bracket to be broken down into modules that can be easily assembled in either configuration for left-hand and right-hand installations in a shower enclosure. The main body of the bracket is a simple cast plate that can be flipped along its axis and mounted to the detachable main wall mounting bracket. Further, the glass panel bracket body is also modular and can be removed and reinstalled after the main body is reversed.

In addition to the advantages described above, the components of the reversible adjustable bracket assembly are simple to produce and require less complicated molds for simple and efficient production. Assembly of the reversible adjustable bracket requires just simple tools. The reversible adjustable bracket assembly provides a range of adjustability and a reversible main body with counter sunk screw holes on top and bottom surfaces, among other desirable features, as described herein.

Figure 1:
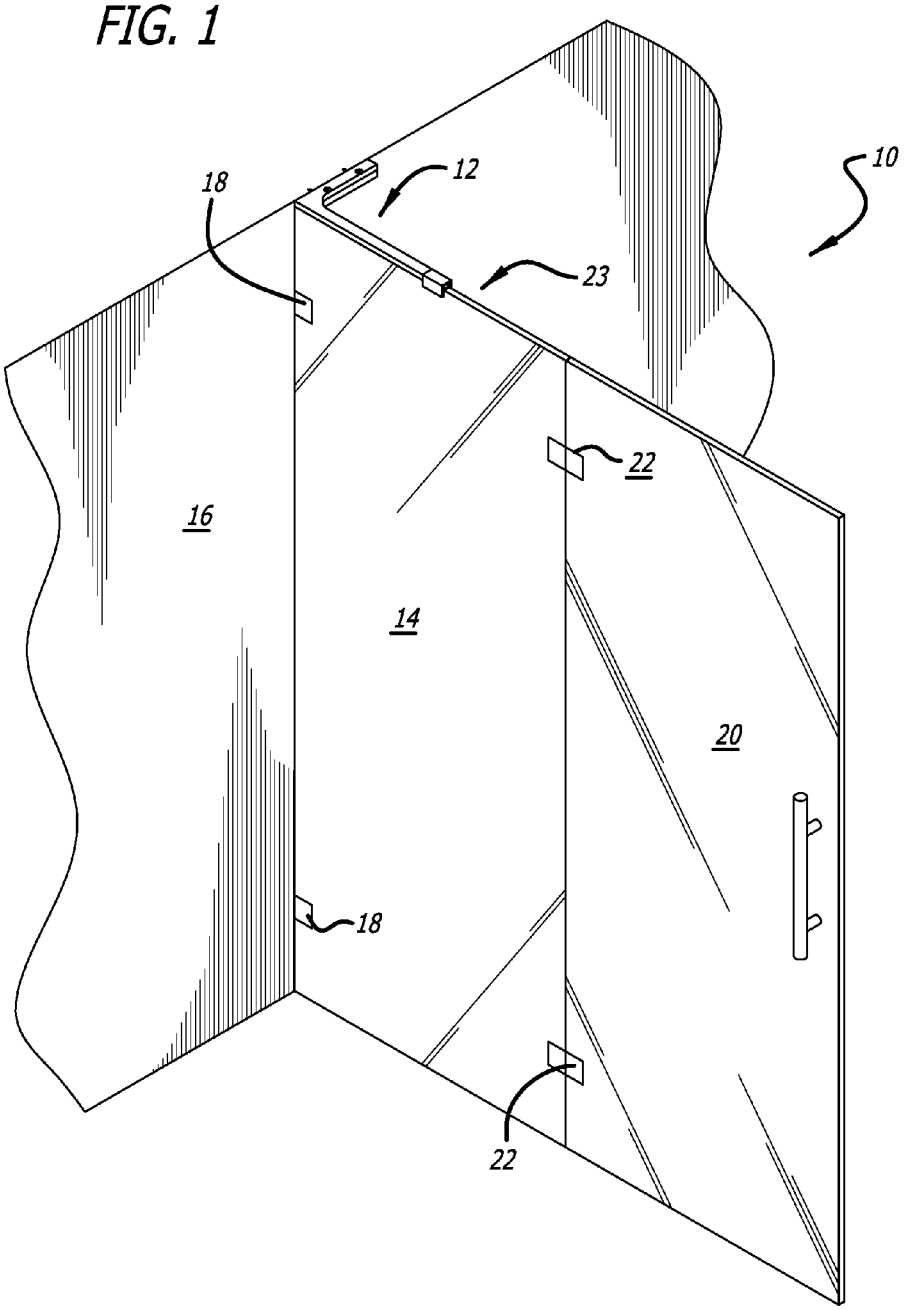
FIG. 1 is a perspective view of an example shower enclosure incorporating a reversible adjustable bracket assembly in a left-hand installation in accordance with an embodiment of the present disclosure.
Figure 2:
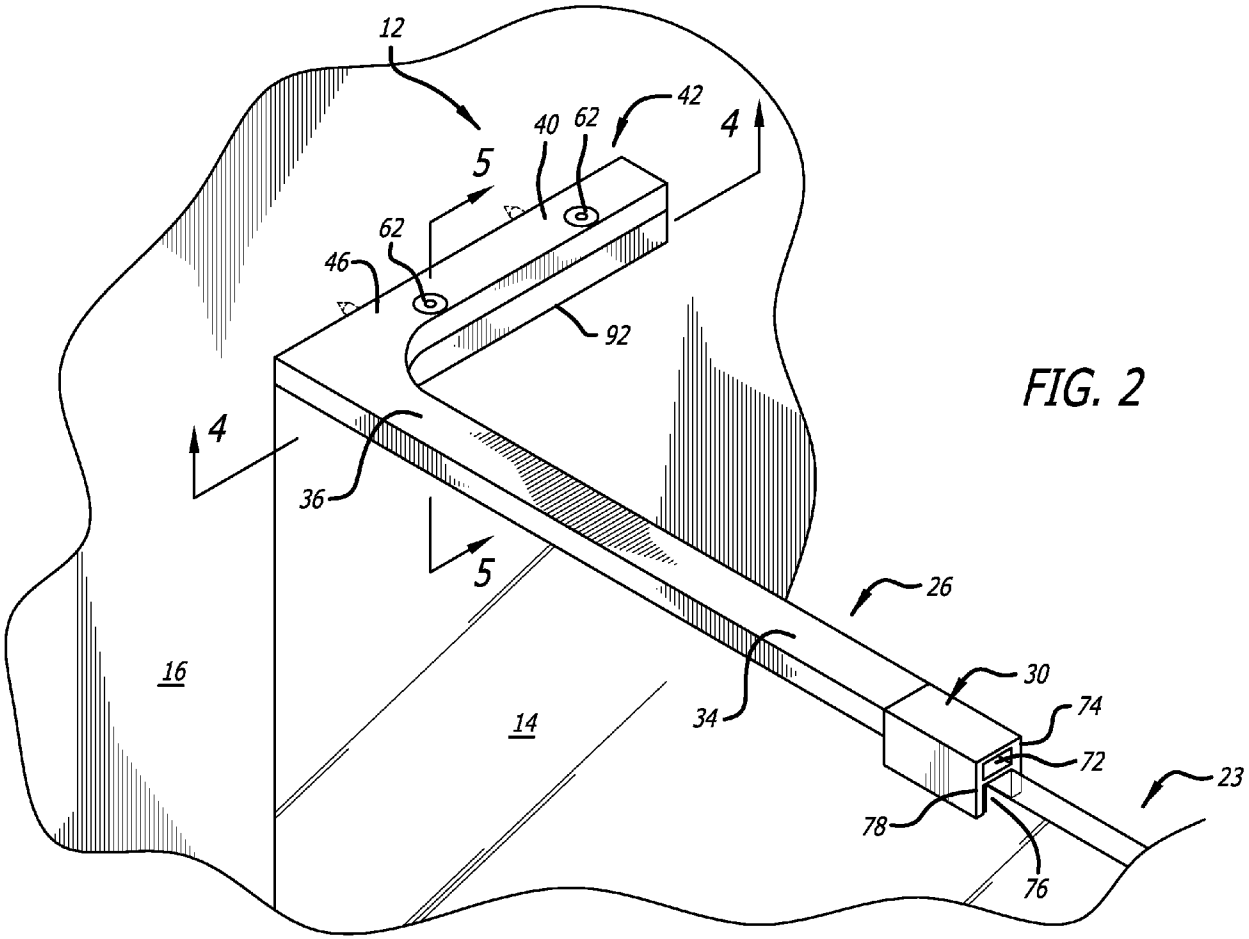
FIG. 2 is an enlarged, top perspective view of the reversible adjustable bracket assembly of FIG. 1.
Figure 3:
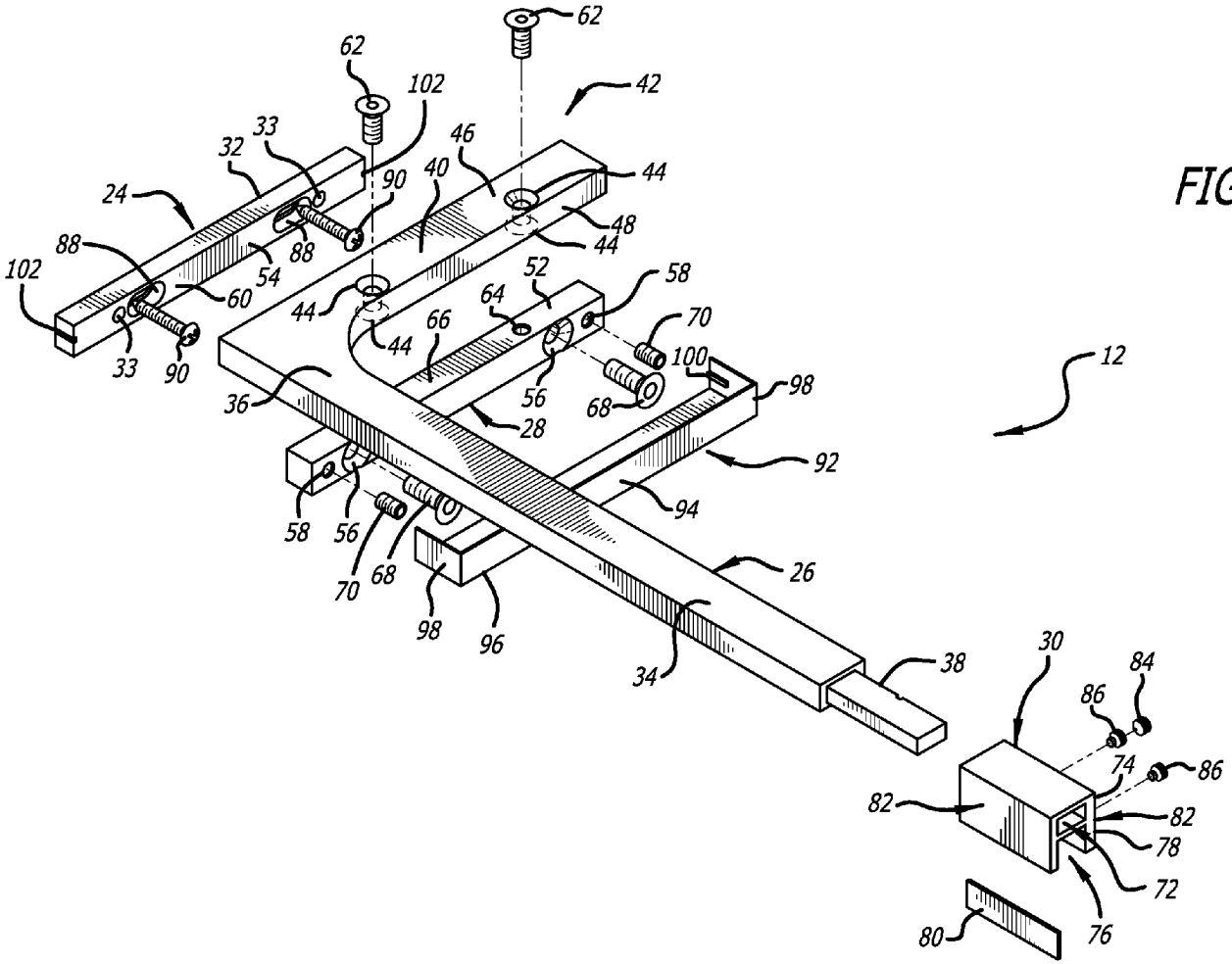
FIG. 3 is an exploded perspective view of the reversible adjustable bracket assembly of FIG. 2.
Figure 4:
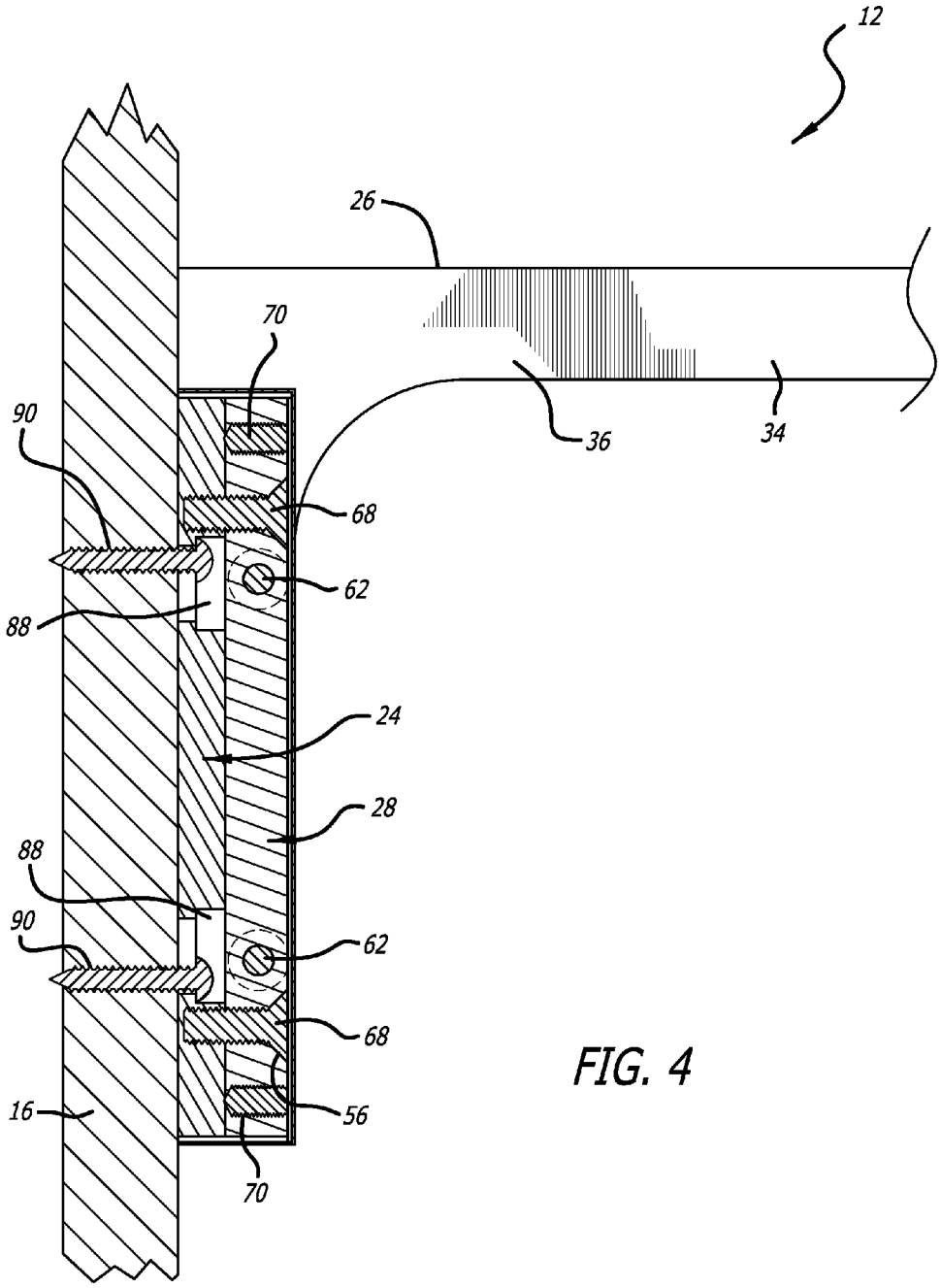
FIG. 4 is a cross-sectional view along the line 4-4 in FIG. 2 of the reversible adjustable bracket assembly shown mounted to a wall.
Figure 5:
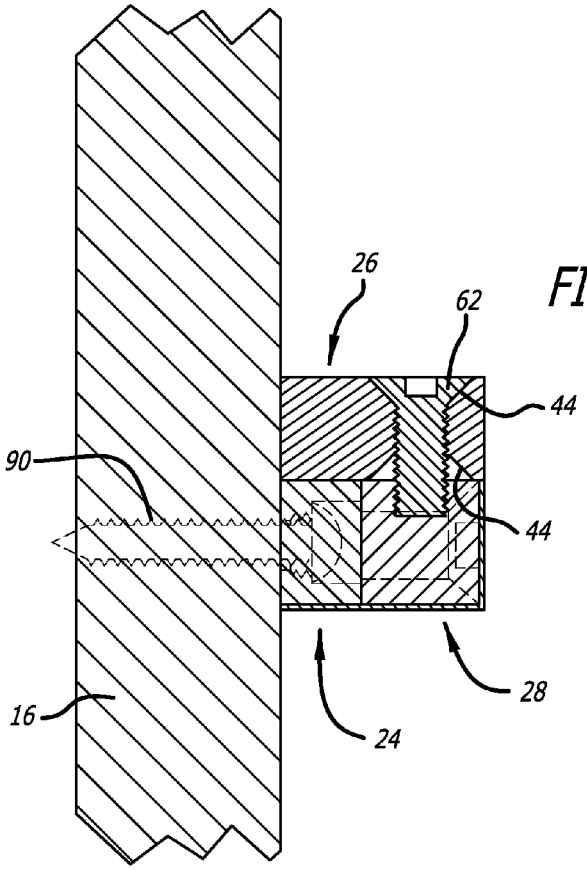
FIG. 5 is a cross-sectional view along the line 5-5 in FIG. 2 of the reversible adjustable bracket assembly shown mounted to the wall.
Figure 6:
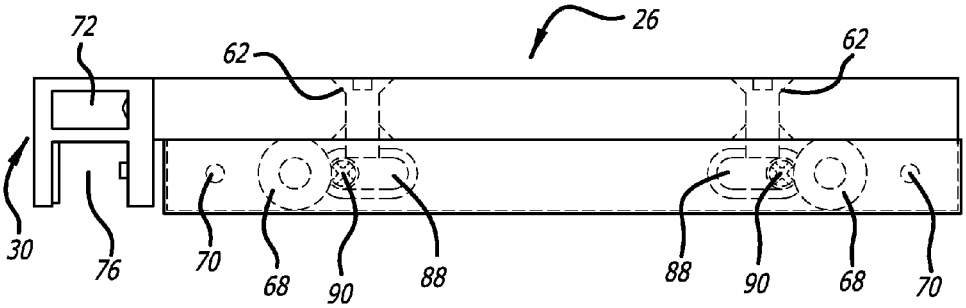
FIG. 6 is a right side elevation view of the reversible adjustable bracket assembly of FIG. 2.

Referring now to FIG. 1 is a perspective view of an example shower enclosure 10 incorporating a reversible adjustable bracket assembly 12 in a left-hand installation described in more detail below in accordance with an embodiment of the present disclosure. The shower enclosure 10 includes a glass panel 14 secured to a surface such as a wall 16 via the reversible adjustable bracket assembly 12 and a pair of side brackets 18. A glass shower door 20 is hingedly connected to the glass panel 14 by a pair of hinges 22. The reversible adjustable bracket assembly 12 extends along a top edge 23 of the glass panel 14 and attaches thereto a distance from the wall 16. Such a configuration maintains a clean aesthetic appearance for the shower enclosure 10 while minimizing twisting of the glass panel 14 compared to if just side brackets 18 were utilized. It should be understood that the reversible adjustable bracket assembly 12 is not limited to the shower enclosure 10 illustrated in FIG. 1.

Figure 7:
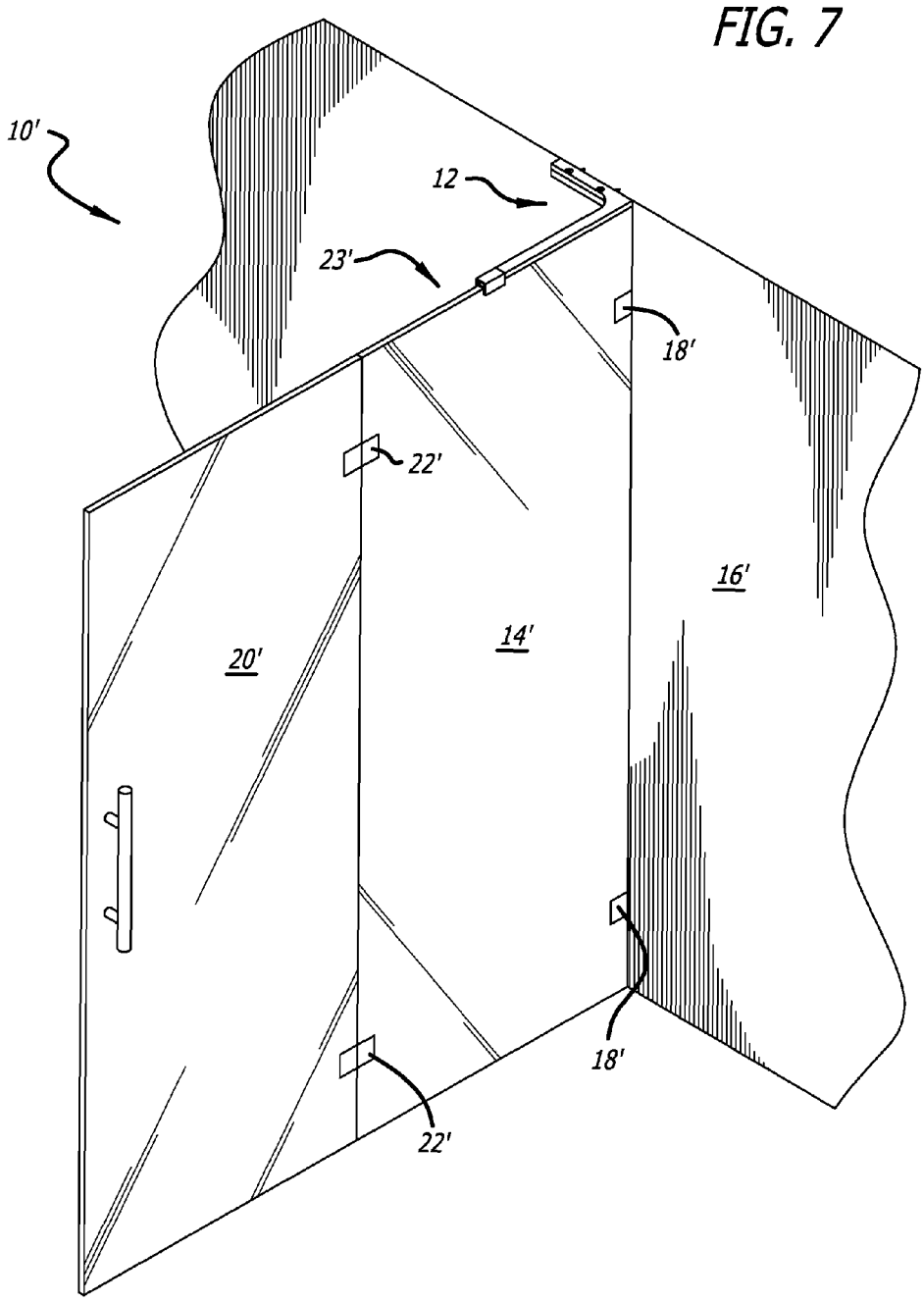
FIG. 7 is a perspective view of an example shower enclosure incorporating a reversible adjustable bracket assembly in a right-hand installation in accordance with an embodiment of the present disclosure.

FIG. 7 is a perspective view of an example shower enclosure 10' incorporating a reversible adjustable bracket assembly 12 in a right-hand installation in accordance with an embodiment of the present disclosure. The shower enclosure 10' includes a glass panel 14' secured to a wall 16' via the reversible adjustable bracket assembly 12' and a pair of side brackets 18'. A glass shower door 20' is hingedly connected to the glass panel 14' by a pair of hinges 22'. The reversible adjustable bracket assembly 12 extends along a top edge 23' of the glass panel 14' and attaches thereto a distance from the wall 16'. Such a configuration maintains a clean aesthetic appearance for the shower enclosure 10' while minimizing twisting of the glass panel 14' compared to if just side brackets 18 were utilized.

It is understood that the illustrated shower enclosures 10 and 10' in FIGS. 1 and 7 are for example only as the reversible adjustable bracket assembly 12 may be utilized to support a glass or non-glass panel in various shower enclosure configurations.

Referring to FIGS. 2-6, the reversible adjustable bracket assembly 12 will be described in more detail. With specific reference to FIGS. 2-3, the reversible adjustable bracket assembly 12 generally includes a mounting bracket 24, a reversible bracket member 26, an interior mounting bracket 28, and a panel bracket 30. The mounting bracket 24 has a body 32 configured for mounting on the surface 16 and defines at least two fastening screw receiving holes 33 therethrough the mounting bracket body 32. The bracket member 26 has a body 34 with an extension arm 36 extending perpendicularly from an elongated, narrowed proximal end 38 to a mounting arm 40 at a distal end 42 of the bracket member body 34. The mounting arm 40 defines at least two fastening screw receiving holes 44 on a first surface 46 and an oppositely disposed second surface 48 thereof such that the bracket member body 34 is configured to be reversible along an axis thereof for mounting to the mounting bracket 24 in at least one of a left-hand and right-hand installation (FIGS. 1 and 7) thereof in the shower enclosure 10, 10'. The interior mounting bracket 28 has a body 52 configured for mounting to an inner side 54 of the mounting bracket body 32 and the first surface 46 or the oppositely disposed second surface 48 of the mounting arm 40. The interior mounting bracket body 52 has at least two fastening screw holes 56 and at least two adjustment screw holes 58 therethrough such that each fastening screw hole 56 aligns with a respective fastening screw receiving hole 33 of the mounting bracket body 32 and each adjustment screw hole 58 aligns with a surface 60 of the mounting bracket body 32.

In accordance with the present disclosure, the reversible adjustable bracket assembly 12 further includes a first fastening screw 62 that extends through each fastening screw hole 44 of the mounting arm 40 and is received in a respective fastening screw hole 64 on a top surface 66 of the interior mounting bracket body 52 to secure the bracket member 26 to the mounting bracket 24 via the interior mounting bracket 28. A second fastening screw 68 extends through each fastening screw hole 56 of the interior mounting bracket body 52 and is received in a respective fastening screw receiving hole 33 of the mounting bracket body 32. An adjustment screw 70, preferably a set screw, is positioned in each adjustment screw hole 58 of the interior mounting bracket body 52 such that each adjustment screw 70 is threadably adjustable to contact the mounting bracket body 32 and adjust the angular relationship between the bracket member 26 and the mounting bracket 24. The second fastening screws 68 can be loosened, or not initially fully tightened, to facilitate angular adjustment via the adjustment screws 70. Once the adjustment of the bracket member 26 relative to the mounting bracket 24 has been completed, the second fastening screws 68 can be fully tightened. The first fastening screws 62 should remain tightened during adjustment of the bracket member 26 relative to the mounting bracket 24.

In the illustrated embodiments, the panel bracket 30 includes an enclosed longitudinal channel 72 at a first end 74 configured for receiving the elongated, narrowed proximal end 38 of the extension arm 36 of the bracket member body 34 therethrough. The panel bracket 30 further includes an open longitudinal channel 76 at a second end 78 configured for supporting the top edge 23 of the panel 14. At least one friction pad 80 is positioned in the open longitudinal channel 76 at the second end 78 adjacent to an outer side wall 82 of the panel bracket 30. At least one set screw 84 (FIG. 3) is secured through the outer side wall 82 of the panel bracket 30 at the first end 74 (top) and at least two set screws 86 (FIG. 3) are secured through the outer side wall 82 of the panel bracket 30 at the second end 78 (bottom) such that the at least one friction pad 80 contacts the top edge 23 of the panel 14 in the open longitudinal channel 76 at the second end 78 when the at least two set screws 86 are adjusted through the outer side wall 82 of the panel bracket 30 at the second end 78. It is understood that the present disclosure is not limited to the illustrated panel bracket as other suitable panel bracket configurations may be used.

Referring to FIGS. 3-6, the mounting bracket body 32 includes at least two mounting through bores 88 through which at least two mounting screws 90 are passed and secured for mounting of the mounting bracket 24 to a wall 16 or other surface. In the illustrated embodiments, the mounting through bores 88 have an elongated or slotted configuration to facilitate lateral adjustment of the position of the mounting bracket 24. While through bores and mounting screws are illustrated, it is understood that the disclosure is not limited to such as the mounting bracket 24 may be otherwise mounted on a wall 16 or other surface, for example, via an adhesive, mortar or other suitable mounting means.

In the illustrated embodiments, the bracket member body 34 is configured to be low-profile such that a height of the extension and mounting arms 36, 40 is less than a width thereof. In some embodiments, the elongated, narrowed proximal end 38 of the extension arm 36 has a height and width less than a height and width of the extension arm 36.

In some embodiments, the interior mounting bracket body 52 has a height and length substantially equal to a height and length of the mounting bracket body 32. In other embodiments, the interior mounting bracket body 52 has a width greater than a width of the mounting bracket body 32.

In accordance with the present disclosure, the reversible adjustable bracket assembly 12 further includes a longitudinal cover member 92 configured to be positioned over and conceal the interior mounting bracket body 52 and the mounting bracket body 32 to provide a clean, finished appearance. In the illustrated embodiments, the longitudinal cover member includes a back surface 94 and a bottom surface 96, both of which extend between opposed end surfaces 98. Each end surface 98 defines an inward projection 100 configured to be received and retained in a respective end slot 102 extending along the mounting bracket body 32. After the mounting bracket body 32 has been secured to the bracket member body 34 via the interior mounting bracket body 52, the longitudinal cover member 92 is positioned over the interior mounting bracket body 52 and mounting bracket body 32 such that the projections 100 are received and retained in the end slots 102. The back surface 94, bottom surface 96 and two end surfaces 98 enclose the interior mounting bracket body 52 and the mounting bracket body 32 such that they are not visible.

In accordance with the present disclosure, the various components of the reversible adjustable bracket assembly can be machined, casted or molded from different materials of adequate strength, such as plastic, metal, metal alloys and the like. The panel bracket can be manufactured for different glass panel thicknesses.

These and other advantages of the present disclosure will be apparent to those skilled in the art. Accordingly, it will be recognized by those skilled in the art that changes or modifications may be made to the above-described embodiments without departing from the broad inventive concepts of the present disclosure. It should therefore be understood that the present disclosure is not limited to the particular embodiments described herein, but is intended to include all changes and modifications that are within the scope and spirit of the disclosure as encompassed by the following claims.

What is claimed is:

1. A reversible adjustable bracket assembly for supporting an edge of a panel relative to a surface, comprising:

a mounting bracket having a body configured for mounting on the surface, the mounting bracket body defining at least two fastening screw receiving holes;

a bracket member having a body with an extension arm extending perpendicularly from an elongated, narrowed proximal end to a mounting arm at a distal end of the bracket member body, the mounting arm defining at least two fastening screw receiving holes on a first surface and an oppositely disposed second surface thereof such that the bracket member body is configured to be reversible for mounting to the mounting bracket in at least one of a left-hand and right-hand installation thereof;

an interior mounting bracket having a body configured for mounting to an inner side of the mounting bracket body and the first surface or the oppositely disposed second surface of the mounting arm, the interior mounting bracket body defining at least two fastening screw holes and at least two adjustment screw holes therethrough, each fastening screw hole aligning with a respective fastening screw receiving hole of the mounting bracket body and each adjustment screw hole aligning with a surface of the mounting bracket body;

a first fastening screw extending through each fastening screw hole of the mounting arm and received in a respective fastening screw hole on a top surface of the interior mounting bracket to secure the bracket member to the mounting bracket via the interior mounting bracket;

a second fastening screw extending through each fastening screw hole of the interior mounting bracket body and received in a respective fastening screw receiving hole of the mounting bracket body;

an adjustment screw positioned in each adjustment screw hole of the interior mounting bracket body such that each adjustment screw is threadably adjustable to contact the mounting bracket body and adjust the angular relationship between the bracket member and the mounting bracket; and a panel bracket defining an enclosed longitudinal channel at a first end configured for receiving the elongated, narrowed proximal end of the extension arm of the bracket member body therethrough and further defining an open longitudinal channel at a second end configured for supporting the edge of the panel.

2. The reversible adjustable bracket assembly of claim 1, wherein the mounting bracket body defines at least two mounting through bores therethrough such that at least two mounting screws are secured through the mounting through bores for mounting of the mounting bracket on the surface.

3. The reversible adjustable bracket assembly of claim 2, wherein each mounting through bore has an elongated configuration.

4. The reversible adjustable bracket assembly of claim 1, wherein the interior mounting bracket body has a height and length substantially equal to a height and length of the mounting bracket body.

5. The reversible adjustable bracket assembly of claim 1, wherein the interior mounting bracket body has a width greater than a width of the mounting bracket body.

6. The reversible adjustable bracket assembly of claim 1, wherein the bracket member body is configured to be low-profile such that a height of the mounting and extension arms is less than a width thereof.

7. The reversible adjustable bracket assembly of claim 1, wherein the elongated, narrowed proximal end of the extension arm has a height and width less than a height and width of the extension arm.

8. The reversible adjustable bracket assembly of claim 1, wherein each adjustment screw is a set screw.

9. The reversible adjustable bracket assembly of claim 1, wherein a plurality of set screws are secured through an outer surface of the panel bracket.

10. The reversible adjustable bracket assembly of claim 1, wherein the panel bracket includes at least one friction pad disposed in the open longitudinal channel at the second end with the at least one friction pad disposed adjacent to an outer side wall of the panel bracket.

11. The reversible adjustable bracket assembly of claim 10, wherein at least one set screw is secured through the outer side wall of the panel bracket at the first end and at least two set screws are secured through the outer side wall of the panel bracket at the second end such that the at least one friction pad contacts the edge of the panel in the open longitudinal channel at the second end when the at least two set screws are adjusted through the outer side wall of the panel bracket at the second end.

12. The reversible adjustable bracket assembly of claim 1, wherein the panel bracket is configured to be detachable from the bracket member body.

13. The reversible adjustable bracket assembly of claim 1 further comprising a longitudinal cover member configured to be positioned over and conceal the interior mounting bracket body and the mounting bracket body.

14. The reversible adjustable bracket assembly of claim 13, wherein the longitudinal cover member includes a back surface and a bottom surface, both of which extend between opposed end surfaces.

15. The reversible adjustable bracket assembly of claim 14, wherein each end surface defines an inward projection configured to be received and retained in a respective end slot extending along the mounting bracket body.

16. A shower enclosure comprising:

at least one reversible adjustable bracket assembly according to claim 1 with the mounting bracket secured to a wall that defines the surface; and a glass panel positioned along the surface with a top edge of the glass panel positioned in and supported by the panel bracket.

* * * * *